United States Patent [19]

Kaplan

[11] Patent Number: 4,689,829

[45] Date of Patent: Sep. 1, 1987

[54] SEAT CONVERING DEVICE FOR SKIERS

[76] Inventor: Robert M. Kaplan, 5546 E. Sanna, Paradise Valley, Ariz. 85253

[21] Appl. No.: 935,018

[22] Filed: Nov. 26, 1986

[51] Int. Cl.[4] ..... A41D 27/12

[52] U.S. Cl. ..... 2/46; 2/69

[58] Field of Search ..... 2/46, 48, 69, 70, 231

[56] References Cited

U.S. PATENT DOCUMENTS

| | | | |
|---|---|---|---|
| 1,099,931 | 6/1914 | Paull | 2/273 |
| 1,604,085 | 10/1926 | Stein | 2/46 |
| 3,708,799 | 1/1973 | Smith et al. | 2/46 |
| 4,459,703 | 7/1984 | Kosmas et al. | 2/48 |

*Primary Examiner*—Doris L. Troutman

*Attorney, Agent, or Firm*—Warren F. B. Lindsley

[57] ABSTRACT

An improved covering device to be used by skiers for protection against snow and moisture that has accumulated on the seat of a chair lift is disclosed. The device comprises a waterproof pad that hangs from the rear of a belt secured about the skier's waist. The pad is rolled up to the belt for storage between periods of use and is held in the stored position by elastic loops slipped over the ends of the roll.

3 Claims, 7 Drawing Figures

SEAT CONVERING DEVICE FOR SKIERS

BACKGROUND OF THE INVENTION

A common cause for discomfort to skiers who use a chair lift is the wet and cold condition of the seats of the lift.

It is not convenient for the skier to carry a cloth for drying or covering the seat because of the absence of a suitable pocket or pouch in his or her clothing to hold the cloth while skiing. Furthermore, it is difficult to position the cloth properly and have it remain so while getting into the chair under the prevailing conditions of the continuously moving lift. It is also difficult and dangerous to adjust the position of the cloth with the chair in motion.

What is needed is a special device or article of clothing that appropriately positions itself as the skier mounts the chair. Any preparation prior to mounting the chair and the stowing of the device after its use should be quickly and easily accomplished, and the device or article of clothing should not detract from the skier's appearance.

DESCRIPTION OF THE PRIOR ART

U.S. Pat. No. 4,459,703 discloses a seat protection device for skiers comprising a protective flap suspended from a container. The container is attached to the rear portion of a belt that is worn about the skier's waist. When in use, the flap extends through an opening in the container to cover the skier's seat so that as the skier sits down or slides into the lift, the flap is drawn into position over the seat of the chair. After use, the protective flap is rolled or folded into the stored position inside the container.

This patent device does provide the desired protective covering for the seat of the lift. It also properly places and positions itself as the skier gets into the chair. The difficulty of stowing the flap inside the container after use, however, detracts seriously from the convenience of its use.

The device of the present invention provides a substantial improvement over the prior art device in this regard.

SUMMARY OF THE INVENTION

In accordance with the invention claimed, an improved protective seat covering device is provided for use by skiers to cover the seat of a chair lift for protection against cold and melting snow. The protective covering is in the form of a flap that is suspended during use from the rear portion of a belt that fastens about the skier's waist. After use, the flap is rolled up and secured at each end by elastic loops.

It is, therefore, an object of this invention to provide an improved protective seat covering device to be worn by skiers for covering the seat of a chair lift.

Another object of this invention is to provide such a seat covering device in a form that may be quickly and conveniently stowed away on the skier between periods of use in a neat and compact way so that it does not detract from the appearance of the skier.

A further object of this invention is to provide such a seat covering device in a form that may be quickly and easily released from its stored position and readied for use as the skier prepares to mount a chair lift.

A still further object of this invention is to provide such a seat covering device in a form that properly positions itself as the skier sits down on the chair of a lift.

A still further object of this invention is to provide such a seat covering device in a form that provides the desired protection against cold and melting snow that may be present on the seat of a chair lift.

Yet another object of this invention is to provide such a protective covering device in a form that is pleasing in appearance and inexpensive to produce.

Further objects and advantages of the invention will become apparent as the following description proceeds, and the features of novelty which characterizes the invention will be pointed out with particularity in the claims annexed to and forming a part of this specification.

BRIEF DESCRIPTION OF THE DRAWING

The present invention may be more readily described with reference to the accompanying drawing, in which.

DESCRIPTION OF THE PREFERRED EMBODIMENT

Figure 1:
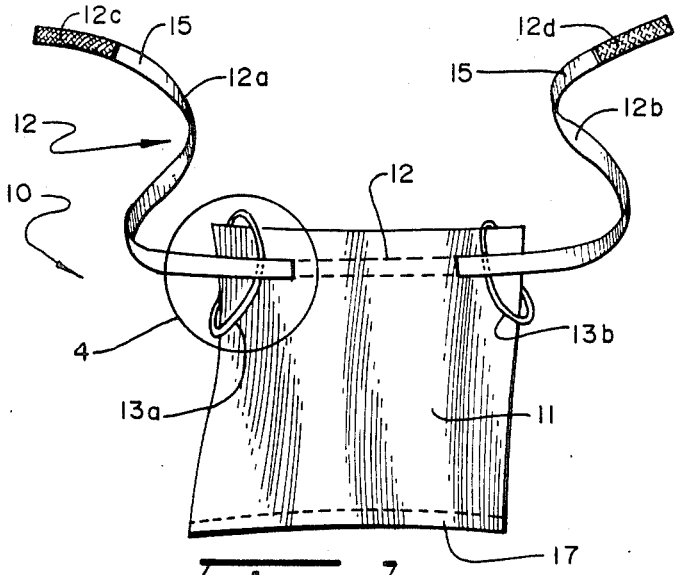
FIG. 1 is a perspective view showing the protective seat covering device of this invention.

Referring more particularly to the drawing by characters of reference, FIGS. 1–5 disclose an improved seat covering device 10 for skiers comprising a protective rollable pad or flap 11, two straps 12A and 12B extending laterally therefrom to form a belt and two roll engaging elastic loops 13A and 13B.

Flap 11 may comprise a thin rectangular pad approximately fifteen inches wide and twenty-two inches long incorporating one or more layers, i.e. laminated, of the same or different materials in order to achieve a flexible, supple pad with good thermally insulating qualities. Its outer surfaces should be nonabsorbant and readily shed water or snow.

Straps 12A and 12B are attached by stitching 14 to the top two corners of pad 11 so as to extend horizontally therefrom when worn in opposite directions and forming with the top edge of pad 11 a belt 12 which may be strapped around the waist of the skier. For this purpose, the free ends 15 of straps 12A and 12B are provided with suitable fastening means 12C and 12D, the preferred embodiment of which may comprise a VELCRO fastener having two engagable interlocking parts, one stitched in place at each end of the straps. Other types of fasteners such as buckles, buttons, snaps or any other appropriate means may be employed to secure the ends of the straps together about the skier's waist, including the alternative of simply tying the ends together.

Figure 4:
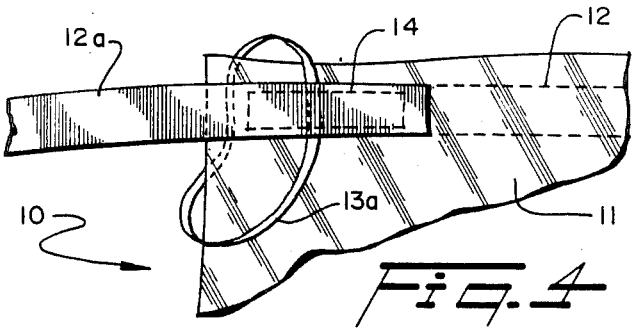
FIG. 4 is a close-up view of a portion of the seat covering device showing details of construction in circled area 4 of FIG. 1, including the belt attachment and the loop that is employed to retain the protective device in its stored position.

It will be readily apparent that the two straps 12A and 12B may be replaced by a single strap or belt 12 extending across flap 11 as suggested by the broken lines in FIGS. 1 and 4. As indicated, belt 12 would be attached to extend along the top edge of pad 11.

Figure 3:
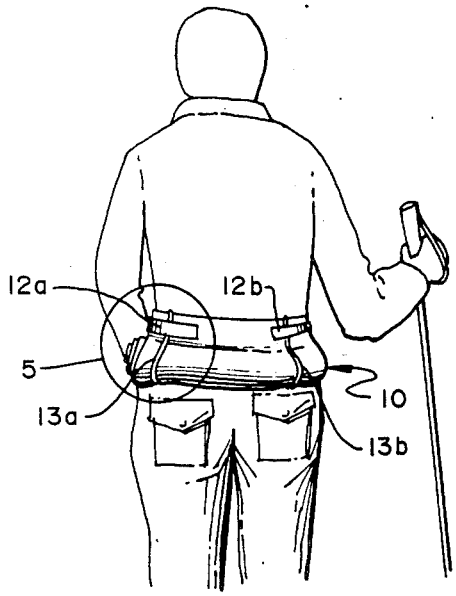
FIG. 3 is a perspective view of a skier wearing the protective seat covering device of the invention with the protective flap shown in its stored position.
Figure 5:
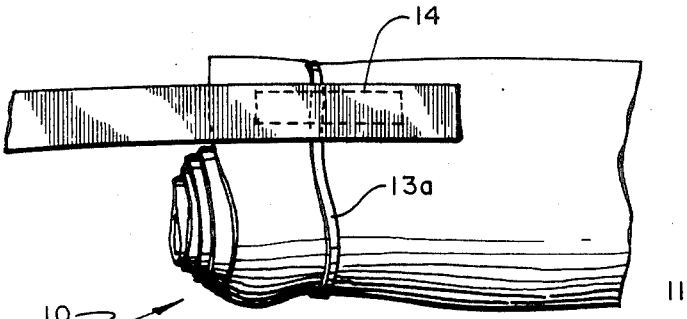
FIG. 5 is an enlarged perspective view of the circled area 5 of FIG. 3, showing the seat covering device with the protective flap rolled for storage and secured by elastic loops.

Loops 13A and 13B are preferably made of elastic strips in appropriate dimensions to pass snugly over the ends of pad 11 when pad 11 is rolled from one end into a relatively tight roll as shown in FIGS. 3 and 5. FIGS. 1, 4 and 5 illustrate that loops 13A and 13B are secured at a point along their length to the upper left and right-hand corners of pad 11 extending between the adjoining surfaces of pad 11 and straps 12A and 12B. The loops may be secured by the same stitching 14 that secures straps 12A and 12B to pad 11. In the preferred embodiment, the diameter of the rolled pad 11 is approximately two inches in size.

Figure 2:
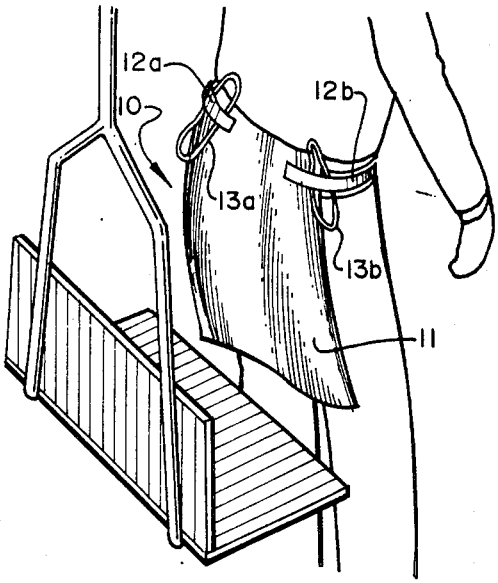
FIG. 2 is a perspective view showing a skier wearing the seat covering device of the invention with the protective flap extended for use as the skier prepares to sit down on the chair of a ski lift.

The use of the protective seat covering device 10 is illustrated in FIG. 2 wherein the rolled pad 11 has been released to unroll by pulling loops 13A and 13B away from the ends of the rolled up pad 11. With the loops removed, pad 11 unrolls itself and hangs suspended from straps 12A and 12B. If desired, the lower end of pad 11 may be weighted by suitable means 17, such as a reinforced end, to aid in unrolling it to its extended position. The skier then simply backs up to the chair of the lift and slides back into the chair as he sits down. Pad 11 is thus seen to be drawn naturally into position with no help needed from the skier's hands.

Figure 6:
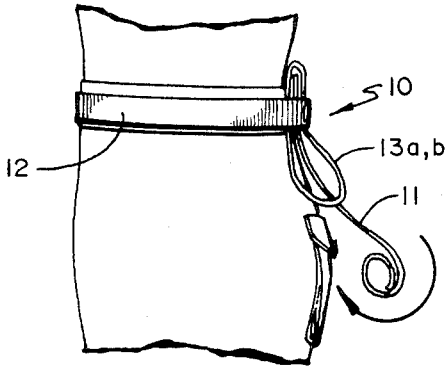
FIGS. 6 and 7 are side views showing a person wearing the protective device and illustrating the procedure for rolling and storing the device.
Figure 7:
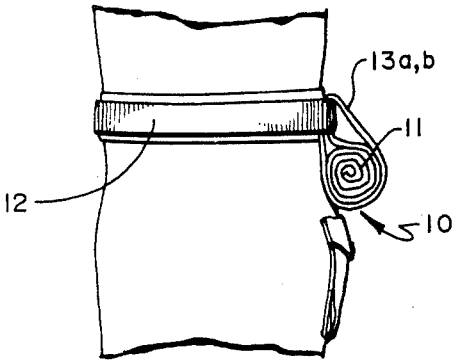

At the end of the ride in the lift, the skier first brushes or shakes any moisture or snow from the pad which by virtue of the characteristic of the pad material will be only loosely held on the material surface. Then, as illustrated in FIG. 6, he or she grabs the lower end of pad 11 and rolls it all the way up to belt 12. To complete the storage procedure, loops 13A and 13B are slipped over the ends of the rolled pad 11 as shown in FIGS. 3, 5 and 7. The loops are seen to pass neatly around the ends of the roll without interference from straps 12A and 12B.

An effective and inexpensive seat covering is thus provided with all the features of convenience and functionality defined in the stated objects of the invention, and although but a single embodiment of the invention has been illustrated and described, it will be apparent to those skilled in the art that various changes and modifications may be made therein without departing from the spirit of the invention or from the scope of the appended claims.

What is claimed is:

1. A seat covering device for skiers comprising:

an elongated flap having a width and length sufficient to cover the seat of a skier, said flap being formed of a supple, lightweight, waterproof material for rolling up and unrolling along its length, belt means secured to one end of said flap and extending laterally thereof for fastening around the waist of a skier, and a pair of loops formed of elastic material mounted on said one end of said flap, one at each side thereof for surrounding the flap when it is rolled up along its length to said belt and releasing the rolled up flap when the loops are moved laterally of the ends of the rolled up flap to cause it to extend downward under the action of gravity over the seat of the skier.

2. The seat covering device set forth in claim 1 wherein:

said belt means comprises two elongated strips, one strip extending from each side of said flap, and a VELCRO connector comprising two engagable interlocking parts with a different part mounted one at each end of said strips.

3. The seat covering device set forth in claim 1 wherein:

said flap is formed of a laminated material.

* * * * *

UNITED STATES PATENT OFFICE

CERTIFICATE OF CORRECTION

Patent No. 4,689,829 Dated September 1, 1987

Inventor(s) Robert M. Kaplan

It is certified that error appears in the above-identified patent and that said Letters Patent are hereby corrected as shown below:

In the title, each occurrence, cancel "CONVERING" and substitute ---COVERING---.

Signed and Sealed this

First Day of March, 1988

*Attest:*

*Attesting Officer*

DONALD J. QUIGG

*Commissioner of Patents and Trademarks*